United States Patent [19]

Sherwood

[11] 4,355,486

[45] Oct. 26, 1982

[54] SLIDABLE DOOR ASSEMBLY

[75] Inventor: Edward F. Sherwood, Gettysburg, Pa.

[73] Assignee: Westinghouse Electric Corp., Pittsburgh, Pa.

[21] Appl. No.: 171,587

[22] Filed: Jul. 23, 1980

[51] Int. Cl.[3] ..... E05D 13/02

[52] U.S. Cl. ..... 49/409

[58] Field of Search ..... 49/409, 410, 411

[56] References Cited

U.S. PATENT DOCUMENTS

| | | | |
|---|---|---|---|
| 246,286 | 8/1881 | Brinton | 49/410 X |
| 1,177,018 | 3/1916 | Clemmons | 49/410 |
| 2,905,463 | 9/1959 | Borden | 49/409 X |
| 3,426,480 | 2/1969 | Dzamba | 49/410 |

*Primary Examiner*—Kenneth Downey

*Attorney, Agent, or Firm*—D. R. Lackey

[57] ABSTRACT

A slidable door assembly for opening and closing an opening or entranceway including a hanger plate having hanger and up-thrust rollers thereon, a door panel fixed to the hanger plate, and a support structure disposed above the door opening. The support structure includes a hanger track upon which the hanger rollers travel, and a horizontally oriented guide or bearing surface which co-acts with the up-thrust rollers. A door stabilizer is fixed to the door panel, adjacent to its trailing edge, with reference to its closing movement, which includes a roller whose rotational axis is disposed outside the vertical projection of the door panel. The roller of the door stabilizer co-acts with a guide surface, which may be the same guide surface used by the up-thrust rollers, to protect the up-thrust rollers from excessive force, and prevent untracking of the hanger rollers, when a force is applied to the leading edge of the door panel.

3 Claims, 3 Drawing Figures

SLIDABLE DOOR ASSEMBLY

BACKGROUND OF THE INVENTION

1. Field of the Invention

The invention relates in general to door assemblies, and more specifically to slidable door assemblies and stabilizing arrangements therefor.

2. Description of the Prior Art

Slidable door assemblies are subject to untracking and/or damage to the supporting elements, as well as to jamming and damage to door gibs, when a door panel is subjected to abnormal forces which tend to rock the door about an axis perpendicular to door travel direction. When the slidable door assembly is associated with a form of public transportation, such as an elevator, or a train, untracking of a door and/or damage to a supportive element or door gib requires that the affected car or vehicle be taken out of service until the problem is corrected. Rugged hanger roller and up-thrust roller mounts do not completely solve the problem, especially when the door panel height to width ratio is larger than normal, such as experienced with two speed doors wherein two related panels cooperate to open and close an opening or entrance way. A force applied to the leading edge of the leading door panel, as the doors move to their closed positions, may bend roller mounts, distort the hanger plate, jam the door gib in a sill groove, or untrack the hanger rollers. If the door panel is bolted to the hanger plate, it may cause relative movement between them as the bolts are forced to move in slots provided for initial positioning and alignment.

SUMMARY OF THE INVENTION

Briefly, the present invention is a new and improved slidable door assembly which overcomes the problems of prior art slidable door assemblies by providing a stabilizing roller adjacent to the trailing edge of a door panel, with reference to its closing location, with the rotational axis of the stabilizing roller being outside the vertical projection of the door panel. The stabilizing roller is spaced by a predetermined small dimension from a downwardly facing guide or bearing surface, which is part of the header track or support means for the door, which guide surface may be the same guide surface which coacts with the normal up-thrust rollers fastened to the hanger plate.

The stabilizing roller is preferably attached to the trailing edge of the door panel, with the location of the stabilizing roller being: (a) outside a point between the centers of the hanger rollers, (b) outside a point between the centers of the up-thrust rollers, and (c) outside the vertical projection of the door panel. This arrangement provides complete protection for the hanger and up-thrust rollers, as well as protection against untracking, as it spreads the force points, and limits and equalizes the forces applied to the hanger and up-thrust rollers.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
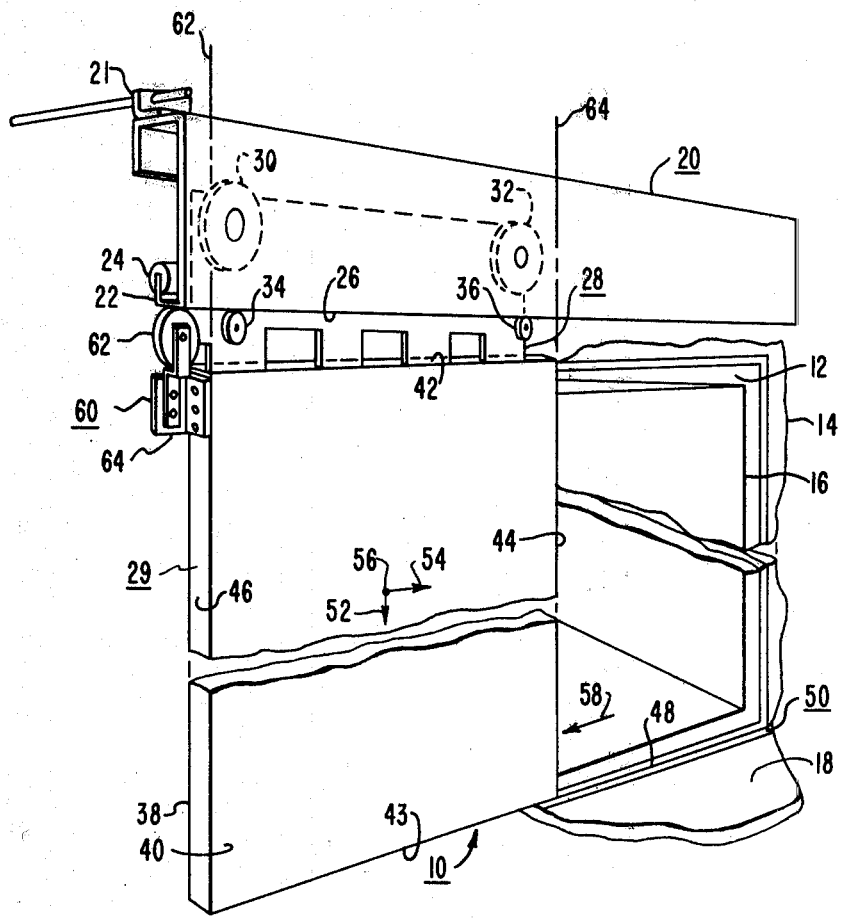
FIG. 1 is a perspective view of a slidable door assembly constructed according to the teachings of the invention.

Referring now to the drawings, and to FIG. 1 in particular, there is shown a slidable door assembly 10 constructed according to the teachings of the invention, arranged to open and close an opening defined by a structure. For purposes of example, the door assembly 10 shown in FIG. 1 is a hatch door assembly associated with an opening 12 and a building 14, with the hatch door assembly being biased towards its closed position and opened by the car door of an elevator car 16 when the elevator car arrives at the floor 18 associated with hatch door assembly 10. However, the invention applies equally to slidable door assemblies used in horizontal transportation vehicles.

The door assembly 10 includes a support structure which includes a header 20, which in an elevator installation is usually supported from the elevator guide rails via suitable brackets 21. Header 20 may be constructed according to the header disclosed in U.S. Pat. No. 3,426,480, which is assigned to the same assignee as the present application, and this patent is hereby incorporated into the present application by reference. Header 20 is formed of sheet steel bent into substantially a J-shaped cross sectional configuration, with the shorter upstanding leg 22 of the J-shaped configuration having a U-shaped strip 24 of resilient material snapped thereon to form a support and travel track for door hanger rollers to be hereinafter described. The downwardly facing flat surface 26 of the bight which interconnects the legs of the J configuration functions as a guide and bearing surface for up-thrust and stabilizer rollers, to be hereinafter described.

Door assembly 10 further includes a hanger plate 28 and a door panel 29. Hanger plate 28, which may be constructed from a flat sheet of steel, includes first and second hanger rollers 30 and 32, and first and second up-thrust rollers 34 and 36, rotatably fixed to a common side.

Door panel 29, which may be formed of steel sheets supported by a suitable core, includes first and second flat major opposed sides or surfaces 38 and 40, respectively, top and bottom edges 42 and 43, respectively, and first and second vertically extending side edges 44 and 46, respectively. The first and second side edges 44 and 46 will also be referred to as the leading and trailing edges, respectively, of door panel 29, referenced relative to their positions when door panel 29 is moving to its closed position, i.e., the position which closes opening 12.

Door panel 29 may be fixed to hanger plate 28 via any suitable means, such as by welding, or, as disclosed in U.S. Pat. No. 4,099,599, which is assigned to the same assignee as the present application, by fastening means which enables the door panel 29 to be quickly and easily adjusted relative to the hanger plate 28, for ease in positioning and aligning door panel 29 during initial installation. This U.S. patent is hereby incorporated into the present application by reference, and thus the joining arrangement is not shown in detail in the instant application.

Hanger plate 28 and door panel 29 are placed in position relative to header 20, with the hanger rollers 30 and 32 engaging the elongated travel track 24, and with the up-thrust rollers 34 and 36 just touching guide surface 26. A door gib (not shown) attached to the bottom edge 43 of door panel 29 cooperates with a groove 48 in a sill 50 located on floor 18 to guide door panel 29 in its travel path between open and closed positions.

When door panel 29 is being operated from its open to its closed position, the various moments or torques developed are indicated by arrows 52 and 54 which have a line of action through the center 56 of gravity of the door panel/hanger plate assembly. Arrow 52 represents the moment of weight, and arrow 54 represents the moment of inertia when the door panel 29 is moving towards its closed position. If, while door panel 29 is moving towards its closed position, a force represented by arrow 58 is suddenly applied to leading edge 44, a moment of force or torque is produced on the door panel and hanger plate assembly equal to the product of the force and the perpendicular distance from the line of action of the force to a point which is the center of rotation induced by the force. Thus, the door panel 29 tends to suddenly rock or rotate CW, as viewed in FIG. 1, with the up-thrust roller 34 and hanger roller 32 taking the full brunt of this rotational force. It will be observed that the moment of inertia 54 adds to the CW rotational force on the door panel/hanger plate assembly, adding to the magnitude of the force which these roller mounts must sustain. The smaller the dimension between the centers of the up-thrust roller 34 and hanger roller 32, the greater the force applied to the roller mounts. Thus, it will be apparent how these forces are substantially increased as the door height is increased, and its width decreased. These forces may be great enough to bend roller mounts, untrack the hanger rollers from the hanger roller track 24, distort the hanger plate 28, and jam the gib in the guide groove 48 of sill 50, in any combination.

The present invention prevents or greatly reduces the incidence of such occurrences, by extending the header 20 and providing stabilizer means 60 outside of the vertical projection of door panel 29, which vertical projection is illustrated as being the area between broken lines 62 and 64. This also places the door stabilizer means 60 outside of an area defined between the centers of the hanger rollers 30 and 32, and also outside an area defined between the centers of the up-thrust rollers 34 and 36.

Door stabilizer means 60 includes a solid metal roller 62, formed of a suitable material, such as aluminum, which is mounted on or adjacent to the rear or trailing edge 46 of the door panel 29. Thus, it is not visible from the floor side of the hatch opening 12. Roller 62 is mounted on an adjustable bracket assembly 64 to be closely spaced from guide surface 26, such as by a maximum dimension of about 0.003 inch. Thus, during normal operation of the door assembly it does not wear or add any drag to the door. However, when the door assembly is subjected to a force 58 which tends to cause CW rotation of the door, it, being outboard from the door panel 29, effectively spreads the support and guidepoints, absorbing excess force and limiting and distributing easily withstandable forces between the hanger and up-thrust rollers.

Figure 2:
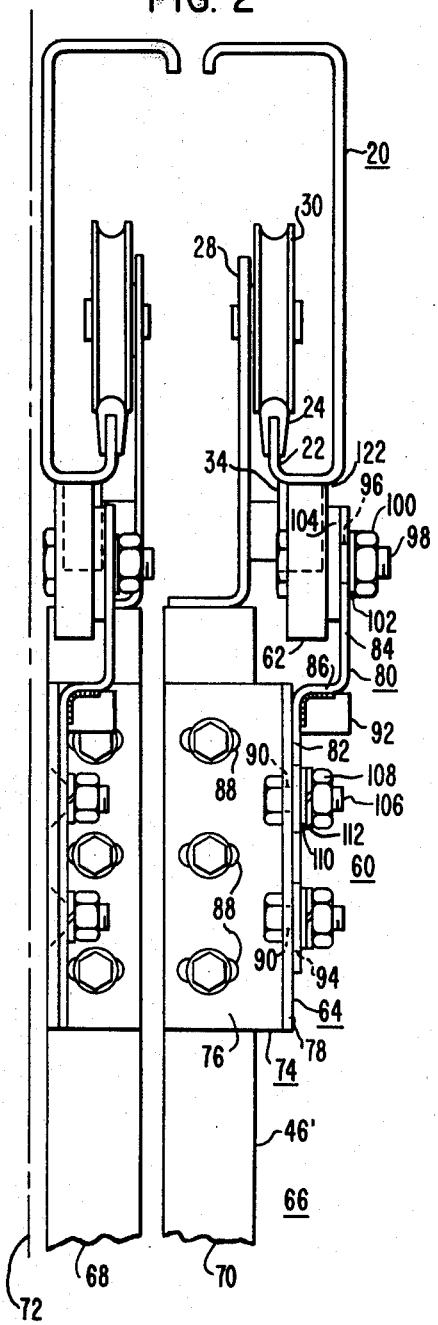
FIG. 2 is an end elevational view of a two speed door arrangement constructed according to the teachings of the invention.
Figure 3:
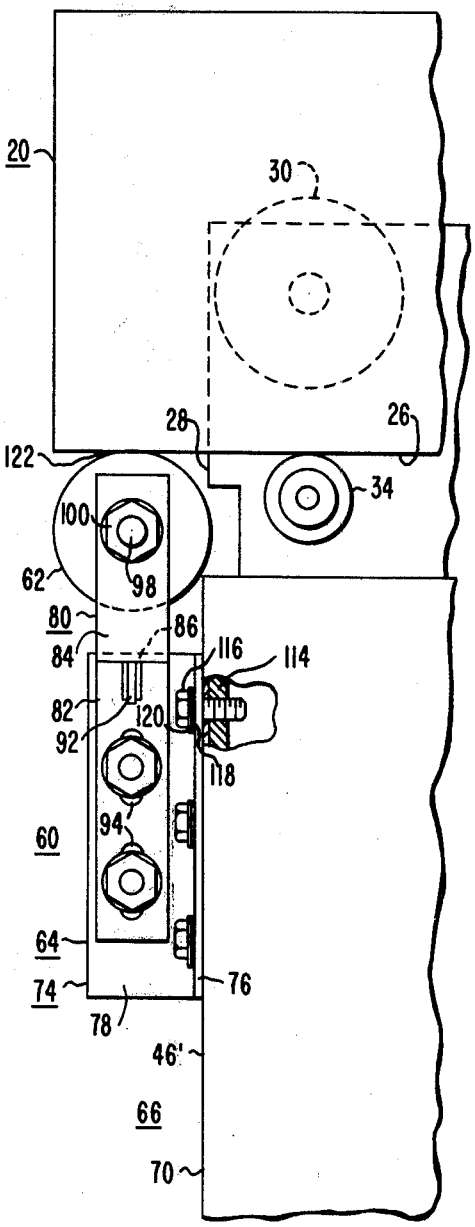
FIG. 3 is a side elevational view of the door arrangement shown in FIG. 2.

FIGS. 2 and 3 are elevational end and side views, respectively, of a two speed hatch door assembly 66 constructed according to the teachings of the invention, which is enlarged, compared with the FIG. 1 illustration, in order to more clearly set forth a preferred mounting arrangement for the door stabilizer means 60. Door assembly 66 includes a slow door 68 and a fast door 70, with the innerwall of structure 14 being indicated by broken line 72. While the door stabilizer means 60 is preferably applied to both the fast and slow doors, as illustrated, it is most important that it be applied to at least the door panel which leads upon door closure, as this panel receives the initial forces upon striking, or being struck by, relatively heavy apparatus such as might be experienced in elevators installed in hospitals.

Since the mounting arrangement for the door stabilizer means for the fast and slow doors are similar, only the mounting arrangement for the fast door will be described in detail, with like reference numerals being used to indicate like components in the figures. Thus, the components already described relative to FIG. 1 will not be described in detail.

More specifically, the mounting means 64 for the door stabilizer roller 62 includes a right angle bracket 74 having first and second leg portions 76 and 78, respectively, and a Z bracket 80 having first and second leg portions 82 and 84, respectively, and an interconnecting portion 86.

Right angle bracket 74, which is preferably formed of cold rolled steel, includes a plurality of elongated openings or slots 88 in the first leg portion 76, with the direction of elongation being perpendicular to the plane of the second leg portion 78. The second leg portion 78 includes round openings 90.

Z bracket 80, which is also formed of cold rolled steel, may be reinforced to prevent bending by welding a rib member 92 to the intermediate and first leg portions 86 and 82, respectively. The first leg portion 82 includes elongated openings or slots 94, with the direction of elongation being perpendicular to the major plane of the intermediate or interconnecting portion 86. The second leg portion 84 includes an opening 96.

Roller 62 is mounted on the second leg portion 84 of Z bracket 80 via a bolt 98, which extends through opening 96, a nut 100, a washer 102, and a spacer 104.

The openings 90 in the second leg portion 78 of right angle bracket 74 are aligned with slots 94 in the first leg portion of Z bracket 80, and the brackets are interconnected via bolts 106, nuts 108, washers 110 and lock washers 112. The nuts 108 are not fully tightened at this stage.

The assembled brackets are then secured to the back or trailing edge 46' of door panel 70. Door panel 70 includes an additional steel bar 114 having openings therein, with this bar being provided to provide a solid anchor for the bracket assembly of the door stabilizer means. Bar 114 is firmly secured to door panel 70, such as by welding. The first leg portion 76 of the right angle bracket 74 is secured to door panel 70 and bar 114 via drill tap screws 116, washers 118, and lock washers 120, with tap screws 116 entering the openings in bar 114. Screws 116 are not fully tightened at this point.

Right angle bracket 74 is then subjected to a slight horizontal force in the direction required to align the stabilizer roller 62 with guide surface 26. Slots 88 being horizontally oriented in their installed position, allow this horizontal adjustment of the stabilizer assembly 64. When roller 62 is properly oriented, screws 116 are securely tightened into the steel bar 114.

Z bracket 80 is then subjected to a slight vertical force, to move the J bracket and roller 62 vertically upward to provide the desired clearance 122 between roller 62 and guide surface 26. Clearance 122 is preferably the smallest dimension which, during normal operation of door panel 70, will not cause contact between roller 62 and surface 26. In practice, this dimension will be a maximum of about 0.003 inch. This clearance will insure that there is no wear of roller 62, or extra drag imposed on the door panel 70, during normal operation. However, the clearance is small enough to quickly allow roller 62 to perform its stabilizing and limiting function when the door panel 70 is subjected to a moment which tends to rock or rotate door panel 70 in a CW direction, as viewed in FIG. 3. It will be noted in FIG. 3 that header 20 extends past the vertical edge of hanger plate 28 to enable the outboard stabilizer roller to cooperate with the header, even in the fully open position of the door panel 70.

In summary, the present invention, wherein door stabilizer roller means is provided adjacent to the trailing or rear edge of a door panel of a slidable door assembly, with a rotational axis of the roller means being outside the vertical projection of the door, will prevent the usual door problems encountered in public transportation systems due to forces applied to the leading edge of the leading door panel. The present invention widens the dimension between the two points which normally take the forces generated when the door is rocked or subjected to forces which tend to rotate the door panel. Anchoring one of these contact points to the door panel, rather than to the hanger plate, protects the hanger plate from distortion, and it protects the hanger mounted up-thrust rollers by limiting the force that can be applied thereto. It also prevents untracking of the hanger rollers from their guide and travel track, and it prevents jamming of the door gib in the sill.

What I claim as my invention:

1. An arrangement for limiting the forces applied to spaced hanger rollers and spaced up-thrust rollers associated with a slidable door assembly, which provide the normal support and normal up-thrust protection, respectively, for the door assembly, comprising:

a structure defining a door opening, a hanger plate having a pair of spaced hanger rollers and a pair of spaced up-thrust rollers mounted thereon, a support assembly for said hanger plate disposed above said door opening, said support assembly including a hanger roller track on which the hanger rollers of said hanger plate travel, and a horizontally oriented guide surface for cooperating with said up-thrust rollers, a door panel having top, bottom, and first and second side edges, means fixing said door panel to said hanger plate such that predetermined movement of said hanger plate relative to said support assembly causes said door panel to move between open and closed positions relative to the door opening, with the first and second side edges of the door panel being leading and trailing edges, respectively, as said door panel moves from its open to its closed position, and door stabilizer means fixed to said door panel, adjacent to its trailing edge, said door stabilizer means including a stabilizer roller whose rotational axis is: (a) spaced from the trailing edge of the door panel, (b) outside the vertical projection of the door panel, (c) outside the spacing between the pair of spaced hanger rollers, and (d) outside the spacing between the pair of spaced upthrust rollers, said stabilizer roller cooperating with the horizontally oriented guide surface of said support assembly when a predetermined force is applied to the leading edge of said door panel, with said roller contacting said guide surface, at least during the application of the predetermined force, to limit the forces applied to said up-thrust and hanger rollers and prevent said hanger rollers from being displaced from the hanger roller track.

2. The door assembly of claim 1 wherein the stabilizer roller is spaced a maximum of about 0.003 inch from the guide surface, in the absence of a force against the leading edge of the door panel.

3. The door assembly of claim 1 wherein the diameter of the stabilizer roller of the stabilizer means exceeds the diameter of the up-thrust rollers.

* * * * *